US010470263B2

(12) United States Patent
Dixon

(10) Patent No.: US 10,470,263 B2
(45) Date of Patent: Nov. 5, 2019

(54) DIMMABLE LIGHTING SYSTEMS AND METHODS OF DIMMING LIGHTING SYSTEMS

(71) Applicant: Cree, Inc., Durham, NC (US)

(72) Inventor: Mark Edward Dixon, Morrisville, NC (US)

(73) Assignee: IDEAL INDUSTRIES LIGHTING LLC, Durham, NC (US)

( * ) Notice: Subject to any disclaimer, the term of this patent is extended or adjusted under 35 U.S.C. 154(b) by 190 days.

(21) Appl. No.: 14/102,037

(22) Filed: Dec. 10, 2013

(65) Prior Publication Data

US 2015/0163878 A1 Jun. 11, 2015

(51) Int. Cl.
*H05B 33/08* (2006.01)
*H05B 37/02* (2006.01)

(52) U.S. Cl.
CPC ..... *H05B 33/0845* (2013.01); *H05B 37/0209* (2013.01); *H05B 33/0815* (2013.01); *H05B 37/02* (2013.01); *H05B 37/0254* (2013.01)

(58) Field of Classification Search
CPC ..... H05B 33/0845; H05B 33/0815; H05B 37/0263; H05B 37/02; H05B 37/0209; H05B 33/0848; H05B 33/0851; H05B 37/0227; H05B 37/0272; H05B 33/0809; H05B 33/089; H05B 33/0893; H05B 37/0245; H05B 37/0281
USPC .... 315/209 R, 224, 283, 291, 306, 308, 360
See application file for complete search history.

(56) References Cited

U.S. PATENT DOCUMENTS

| | | | | |
|---|---|---|---|---|
| 5,408,403 | A | 4/1995 | Nerone et al. | |
| 5,488,269 | A | 1/1996 | El-Hamamsy et al. | |
| 5,734,230 | A | 3/1998 | Edwards et al. | |
| 5,808,417 | A | 9/1998 | Ference et al. | |
| 6,507,157 | B1 | 1/2003 | Erhardt et al. | |
| 6,509,657 | B1 | 1/2003 | Wong et al. | |
| 7,027,010 | B2 | 4/2006 | Lee | |
| 7,088,059 | B2 | 8/2006 | Mckinney et al. | |
| 7,138,994 | B2 | 11/2006 | Cho et al. | |
| 7,511,971 | B2 | 3/2009 | Lim | |
| 7,902,769 | B2 * | 3/2011 | Shteynberg | H05B 33/0815 315/291 |
| 8,451,116 | B2 * | 5/2013 | Steiner | G01J 1/02 340/545.3 |
| 8,461,794 | B2 | 6/2013 | Schrod et al. | |
| 2006/0066258 | A1 | 3/2006 | Lane et al. | |
| 2007/0273290 | A1 | 11/2007 | Ashdown et al. | |
| 2008/0055077 | A1 | 3/2008 | Lane et al. | |

(Continued)

OTHER PUBLICATIONS

International Standard, AC-supplied electronic ballasts for tubular fluorescent lamps—Performance requirements, CEI/IEC 60929:2006, Third Edition, Jan. 2006, 292 pages.

(Continued)

*Primary Examiner* — Douglas W Owens
*Assistant Examiner* — Borna Alaeddini
(74) *Attorney, Agent, or Firm* — Coats & Bennett, PLLC

(57) ABSTRACT

A lighting apparatus includes a light source, a power input coupled to the light source, and a dimming control module coupled to the power input and the light source. The dimming control module is configured to change a brightness level of the light source in response to toggling of a power signal supplied at the power input. Related methods of operating a lighting apparatus are also disclosed.

21 Claims, 6 Drawing Sheets

(56) References Cited

U.S. PATENT DOCUMENTS

| | | | | |
|---|---|---|---|---|
| 2008/0224617 | A1 | 9/2008 | Keller et al. | |
| 2009/0295776 | A1 | 12/2009 | Yu et al. | |
| 2010/0079091 | A1 | 4/2010 | Deixler et al. | |
| 2010/0135000 | A1 | 6/2010 | Smith, III et al. | |
| 2010/0237840 | A1 | 9/2010 | Walter et al. | |
| 2010/0259239 | A1 | 10/2010 | Shi et al. | |
| 2010/0277070 | A1 | 11/2010 | Butteris et al. | |
| 2010/0301751 | A1* | 12/2010 | Chobot | H05B 33/0815 315/86 |
| 2011/0006691 | A1 | 1/2011 | Blaha et al. | |
| 2011/0043035 | A1 | 2/2011 | Yamada et al. | |
| 2011/0062888 | A1 | 3/2011 | Bondy et al. | |
| 2011/0109164 | A1 | 5/2011 | Mohammed Suhura et al. | |
| 2011/0109249 | A1* | 5/2011 | Liu et al. | 315/307 |
| 2011/0121654 | A1 | 5/2011 | Recker et al. | |
| 2011/0121754 | A1 | 5/2011 | Shteynberg et al. | |
| 2011/0140611 | A1 | 6/2011 | Elek et al. | |
| 2011/0140612 | A1 | 6/2011 | Mohan et al. | |
| 2012/0242247 | A1* | 9/2012 | Hartmann et al. | 315/294 |
| 2013/0063027 | A1 | 3/2013 | Recker et al. | |
| 2013/0334980 | A1* | 12/2013 | Zhou | H05B 33/0845 315/250 |
| 2014/0062341 | A1* | 3/2014 | Reed | H05B 37/0281 315/360 |

OTHER PUBLICATIONS

International Search Report Corresponding to International Application No. PCT/US12/68987; dated Feb. 26, 2013; 10 Pages.

International Search Report and Written Opinion Corresponding to International Application No. PCT/US12/68991; dated Mar. 4, 2013; 10 Pages.

Notification of Transmittal of the International Search Report and the Written Opinion of the International Searching Authority, or the Declaration, PCT/US12/68984, dated May 10, 2013.

Notification Concerning Transmittal of International Preliminary Report on Patentability, PCT/US2012/068987, dated Jun. 26, 2014.

Notification Concerning Transmittal of International Preliminary Report on Patentability, PCT/US2012/068991, dated Jun. 26, 2014.

European Search Report Corresponding to European Patent Application No. 12 85 8507; dated Nov. 30, 2015; 7 Pages.

* cited by examiner

DIMMABLE LIGHTING SYSTEMS AND METHODS OF DIMMING LIGHTING SYSTEMS

FIELD

The present application relates to lighting systems, and in particular to solid state lighting systems and related methods.

BACKGROUND

For interior lighting, the ability to dim a light fixture is a desirable feature. One rudimentary method of dimming control is referred to as step dimming. Step dimming uses multiple switches that allow a user to select one of several (e.g., two or three) different brightness levels for a light fixture by appropriate setting of multiple switches. For example, in a three-bulb fluorescent fixture, one switch may control the two outer bulbs, while another switch may control the single inner bulb. By setting the switches appropriately, the user can turn on one, two, three or no bulbs in the fixture at one time, effectively providing four levels of dimming.

Many control circuits for lighting utilize phase cut dimming. In phase cut dimming, the leading or trailing edge of the line voltage is manipulated to reduce the RMS voltage provided to the light. When used with incandescent lamps, this reduction in RMS voltage results in a corresponding reduction in current and, therefore, a reduction in power consumption and light output. As the RMS voltage decreases, the light output from the incandescent lamp decreases.

In addition to control of the AC signal, other techniques for dimming light sources include 0-10V dimming and pulse width modulation (PWM) dimming. In 0-10V and PWM dimming, a dimming signal separate from the AC signal is provided to the light source. In 0-10V dimming, the dimming signal is a voltage level between 0 and 10V DC. The light source has a 100% output at 10V DC and a minimum output near 1V DC. Additional details on 0-10V dimming can be found in IEC Standard 60929. 0-10V dimming is conventionally used to dim fluorescent lighting.

In PWM dimming, a square wave is provided as the dimming signal. The duty cycle of the square wave can be used to control the light output of the light source. For example, with a 50% duty cycle, the output of the light source may be dimmed 50%. With a 75% duty cycle, the light output may be 75%. Thus, the light output of the light source may be proportional to the duty cycle of the input square wave or to the time average of the input signal for non-square wave inputs.

Recently, solid state lighting systems have been developed that provide light for general illumination. These solid state lighting systems utilize light emitting diodes or other solid state light sources that are coupled to a power supply that receives the AC line voltage and converts that voltage to a voltage and/or current suitable for driving the solid state light emitters. Typical power supplies for light emitting diode light sources include linear current regulated supplies and/or pulse width modulated current and/or voltage regulated supplies.

In the general illumination application of solid state light sources, one desirable characteristic is to be compatible with existing dimming techniques. In particular, dimming that is based on varying the duty cycle of the line voltage may present several challenges in power supply design for solid state lighting. Unlike incandescent lamps, LEDs typically have very rapid response times to changes in current. This rapid response of LEDs may, in combination with conventional dimming circuits, present difficulties in driving LEDs.

For example, one way to reduce the light output in response to the phase cut AC signal is to utilize the pulse width of the incoming phase cut AC line signal to directly control the dimming of the LEDs. The 120 Hz signal of the full-wave rectified AC line signal would have a pulse width the same as the input AC signal. This technique limits the ability to dim the LEDs to levels below where there is insufficient input power to energize the power supply. Also, at narrow pulse width of the AC signal, the output of the LEDs can appear to flicker, even at the 120 Hz frequency. This problem may be exacerbated in 50 Hz systems as the full wave rectified frequency of the AC line is only 100 Hz.

Furthermore, variation in the input signal may affect the ability to detect the presence of a phase cut dimmer or may make detection unreliable. For example, in systems that detect the presence of a phase cut dimmer based on detection of the leading edge of the phase cut AC input, if a reverse-phase cut dimmer is used, the dimming is never detected. Likewise, many residential dimmers have substantial variation in pulse width even without changing the setting of a dimmer. If a power supply detects the presence of dimming based on a threshold pulse width, the power supply could detect the presence of dimming on one cycle and not on another as a result of the variation in pulse width.

A further issue relates to AC dimmers providing some phase cut even at "full on." If the LEDs are directly controlled by the AC pulse width, then the LEDs may never reach full output but will dim the output based on the pulse width of the "full on" signal. This can result in a large dimming of output. For example, an incandescent lamp might see a 5% reduction in power when the pulse width is decreased 20%. Many incandescent dimmers have a 20% cut in pulse width at full on, even though the RMS voltage is only reduced 5%. While this would result in a 5% decrease in output of an incandescent lamp, it results in a 20% decrease in output if the phase cut signal is used to directly control the LEDs.

SUMMARY

A lighting apparatus according to some embodiments includes a light source, a power input coupled to the light source, and a dimming control module coupled to the power input and the light source. The dimming control module is configured to change a brightness level of the light source in response to toggling of a power signal supplied at the power input.

The dimming control module may be configured to detect toggling of the power signal within a predetermined time after the power signal is switched on, and to change the brightness level of the light source in response to toggling of the power signal within the predetermined time after the power signal is switched on.

The dimming control module may be configured to detect repeated toggling of the power signal and to set the brightness level of the light source to respective different levels in response to repeated toggling of the power signal.

The dimming control module may be configured to cycle the brightness level of the light source from a high brightness level to a low brightness level in response to toggling of the power signal.

The dimming control module may be configured to cycle the brightness level of the light source from a lowest brightness level to a highest brightness level in response to toggling of the power signal.

The dimming control module further may include a dimming signal detector, wherein the dimming control module is configured to control the brightness level of the light source in response to toggling of the power signal and in response to a dimming control signal detected by the dimming signal detector.

The dimming signal may include a Digital Addressable Lighting Interface (DALI) dimming signal and/or a 0-10V dimming signal.

The dimming control module may include an AC detector coupled to the power input, a dimming circuit coupled to the AC detector and configured to generate a dimming control signal in response to an output of the AC detector, and a current supply module coupled to the dimming circuit and the light source and configured to supply a level of current to the light source in response the dimming control signal output by the dimming circuit.

The lighting apparatus may further include an energy storage element coupled to the current supply module and configured to maintain a supply of power to the current supply module while the power supply signal is toggled.

The light source may include a solid state lighting array, and wherein the current supply module may include an AC light emitting diode driver circuit.

The dimming circuit may include a microcontroller.

Some embodiments provide methods of operating a lighting device including a light source. The methods include receiving a power signal at the lighting device, and changing a brightness level of the light source in response to toggling of the power signal.

The methods may further include detecting toggling of the power signal within a predetermined time after the power signal is switched on, and changing the brightness level of the light source in response to toggling of the power signal within the predetermined time after the power signal is switched on.

The methods may further include detecting repeated toggling of the power signal, and setting the brightness level of the light source to respective different levels in response to repeated toggling of the power signal.

The methods may further include cycling the brightness level of the light source from a high brightness level to a low brightness level in response to toggling of the power signal.

The methods may further include cycling the brightness level of the light source from a lowest brightness level to a highest brightness level in response to toggling of the power signal.

The methods may further include controlling the brightness level of the light source in response to toggling of the power signal and in response to an external dimming control signal provided to the lighting device.

A solid state lighting apparatus according to some embodiments includes an array of solid state lighting sources, a power input coupled to the array of solid state lighting sources and configured to receive an AC power signal, an AC-DC converter coupled to the power input and configured to convert the AC power signal to a DC power signal, and a current supply circuit coupled to the AC-DC converter and to the array of solid state lighting sources and configured to supply a level of current to the array of solid state lighting sources. The apparatus further includes an AC detector coupled to the power input and a dimming control circuit coupled to the AC detector and to the current supply circuit and configured to generate a brightness control signal in response to toggling of a power signal supplied at the power input. The current supply circuit is configured to receive the brightness control signal from the dimming control circuit and to set a level of current supplied to the array of solid state lighting sources in response to the brightness control signal.

The brightness control signal may include a pulse width modulation signal.

A dimming control apparatus according to some embodiments includes a power input configured to receive an AC power signal, an AC detector coupled to the power input, and a microcontroller coupled to the AC detector and configured to output a dimming control signal in response to toggling of a power signal supplied at the power input.

The dimming control apparatus may further include an AC-DC converter coupled to the power input, and an energy storage element coupled to the AC-DC converter and to the microcontroller and configured to generate an output voltage to power the microcontroller when the power signal is toggled. The dimming control signal may include, for example, a Digital Addressable Lighting Interface (DALI) or 0-10V dimming signal.

Other systems, methods, and/or computer program products according to embodiments of the invention will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION

Figure 1:
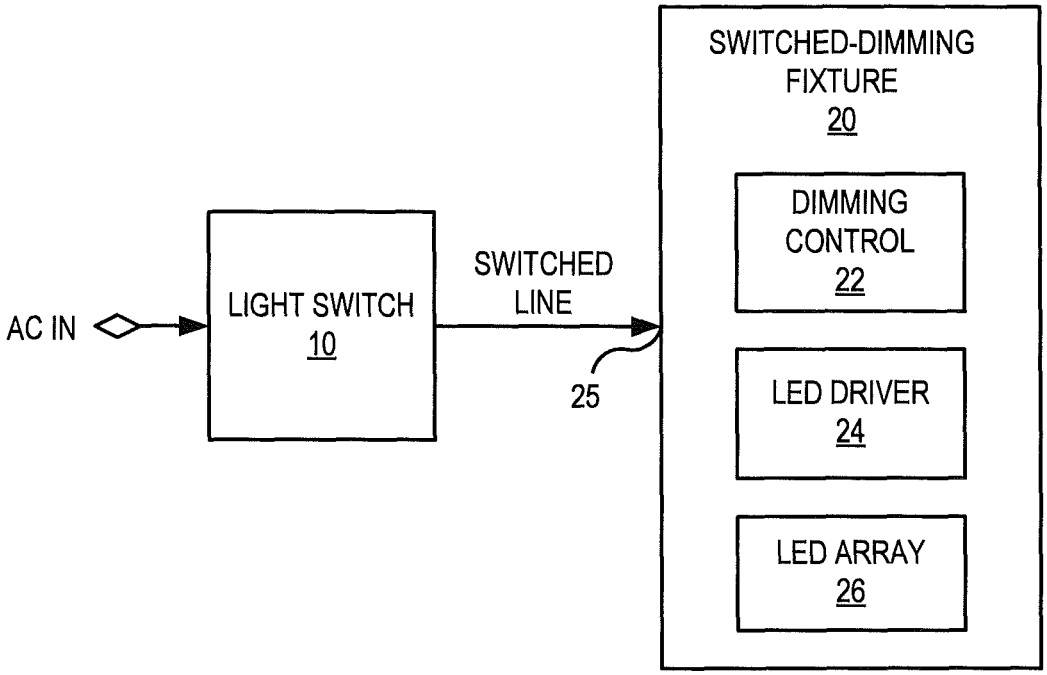
FIG. 1 is a schematic diagram of a dimmable solid state lighting apparatus in accordance with some embodiments.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Some embodiments of the present invention provide solid state lighting apparatus with digitally controlled dimming functions. Digital control may be accomplished by means of a microcontroller, a microprocessor, a field programmable gate array, or other suitable digital circuitry. The term "microcontroller" is used herein to refer to any suitably configured digital control circuitry. Microcontrollers are commonly employed in LED lighting systems for dimming control via remote communications. Some embodiments of the present invention provide a microcontroller based dimming control module for solid state luminaires in which a microcontroller performs dimming control functions.

In many environments, dimming is an important feature for a light fixture to implement. Various different dimming technologies have been developed for both incandescent and fluorescent lighting, which represent the vast majority of installed commercial lighting facilities today. As solid state lighting apparatus are developed and become more available as a replacement technology for incandescent and fluorescent lighting, it is desirable for solid state luminaires to respond appropriately to dimming signals generated by various different types of dimming systems.

One rudimentary method of dimming control is referred to as step dimming. Step dimming uses multiple switches that allow a user to select one of several (e.g., two or three) different brightness levels for a light fixture by appropriate setting of multiple switches. For example, in a three-bulb fluorescent fixture, one switch may control the two outer bulbs, while another switch may control the single inner bulb. By setting the switches appropriately, the user can turn on one, two, three or no bulbs in the fixture at one time, effectively providing four levels of dimming.

0-10 V dimming is an electronic lighting control signaling system that enables continuous dimming between brightness levels. A 0-10V dimming switch generates a DC voltage that varies between zero and ten volts in response to a user setting, such as the position of a slide switch or a dial connected to a potentiometer. The controlled lighting fixture typically scales its output so that it emits full brightness in response to a 10 V control signal and is off (zero brightness) in response to a 1 V control signal. Dimming devices may be designed to respond in various patterns to the intermediate voltages, such as giving output curves that are linear for voltage output, actual light output, power output, perceived light output, etc.

Dimming fluorescent ballasts and dimming LED drivers often use 0-10 V control signals to control dimming functions. In many cases, however, the dimming range of the power supply or ballast is limited.

Digital Addressable Lighting Interface (DALI) is a technical standard for network-based systems that control lighting in buildings. It was established as a successor for 0-10 V lighting control systems. The DALI standard, which is specified in the IEC 60929 standard for fluorescent lamp ballasts, encompasses the communications protocol and electrical interface for lighting control networks. A DALI network consists of a controller and one or more lighting devices (e.g., electrical ballasts and dimmers) that have DALI interfaces. The controller can monitor and control each light by means of a bi-directional data exchange. Data is transferred between controller and devices by means of an asynchronous, half-duplex, serial protocol over a two-wire differential bus.

In some cases, a solid state lighting apparatus may be fitted to an installation that does not have a dimming system. In such cases, it is desirable to provide a solid state lighting apparatus that can be dimmed even without an external dimming system. That is, it is desirable to provide a solid state lighting apparatus that can be dimmed absent the presence of a dimming controller that generates DALI or 0-10V dimming signal, a phase cut dimmer, or multiple switches needed for step dimming.

FIG. 1 illustrates a solid state lighting apparatus 20 according to some embodiments. The solid state lighting apparatus 20 includes a dimming control circuit 22 that allows the fixture 20 to be dimmed without need for an external dimmer, such as a phase cut dimmer, or a dimming control system that responds to an external dimming signal, such as a DALI dimming signal or a 0-10V dimming signal.

The solid state lighting apparatus 20 also includes an LED driver circuit 24 and an LED array 26. The dimming control circuit 22 controls a level of current supplied to the LED array 26 by the LED driver circuit 24 in response to toggling (i.e., switching off and back on in close succession) of a switched power signal provided at a power input 25 to the solid state lighting apparatus 20. In some systems, the level of current may be affected by a change in voltage, which controls the dimming of the LED array 26.

Still referring to FIG. 1, power is supplied to the solid state lighting apparatus 20 through a switched AC line that is coupled to a light switch 10. The light switch 10 may be, for example, a single pole single throw (SPST), single pole dual throw (SPDT), 3-way, 4-way, rotary, relay controlled or other suitable type of switch. After power to the solid state lighting apparatus 20 has been switched on at the light switch 10, the solid state lighting apparatus 20 may be selectively dimmed by toggling the light switch 10. In particular, the dimming control circuit 22 responds to toggling of the light switch 10 by changing a level of power (voltage and/or current) supplied by the LED driver 24 to the LED array 26. It will be appreciated that more than one switch, such as 3- or 4-way switches, can be coupled to the fixture 20.

Figure 2:
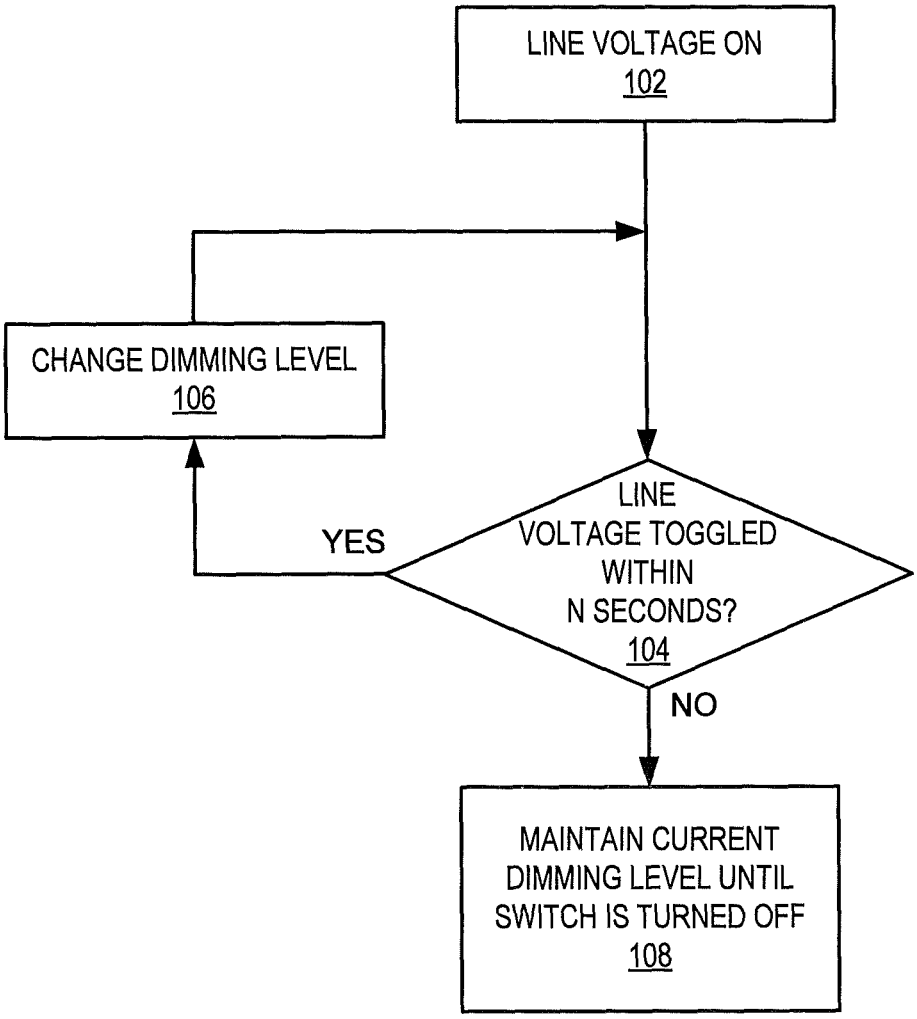
FIGS. 2 and 3 are flowcharts of operations performed by systems/methods in accordance with some embodiments.
Figure 3:
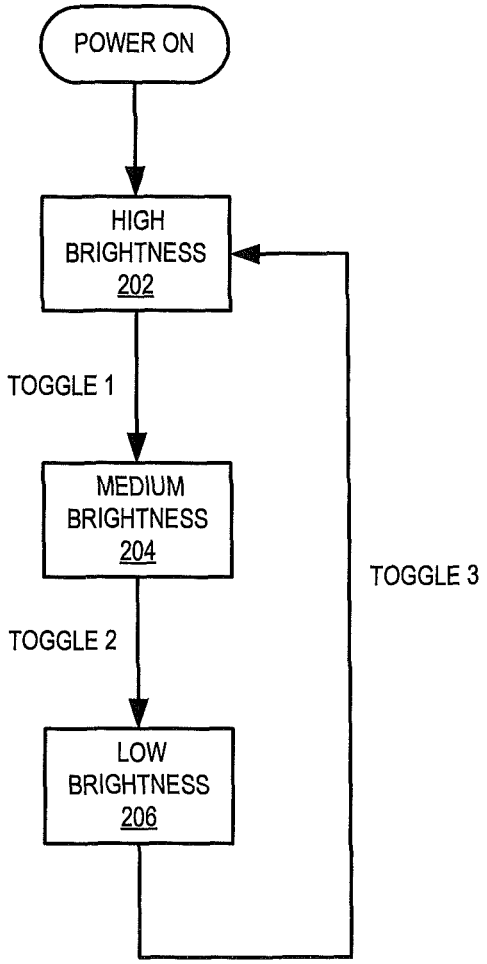

FIGS. 2 and 3 are flowcharts that illustrate operations of a solid state lighting apparatus 20 according to some embodiments, and in particular of a dimming control circuit 22 in a solid state lighting apparatus 20 according to some embodiments. Referring to FIG. 2, after the switch 10 is turned on and a line voltage is applied to the solid state lighting apparatus 20 (block 102), the dimming control circuit 22 monitors the voltage input to the solid state lighting apparatus 20 (block 104). If the line voltage is toggled, i.e., switched off and back on in close succession within a predetermined number of seconds N, the dimming control circuit 22 causes the dimming level of the solid state lighting apparatus 20 to change (block 106). If the line voltage is not toggled within the predetermined number of seconds N, then the current dimming level is maintained until the switch is turned off (block 108).

In some embodiments, the dimming feature may only be activated if the input voltage is toggled within a predetermined number of seconds n after the input voltage is turned on. In other embodiments, the dimming feature may be activated any time the input voltage is toggled.

The input voltage may be determined to have been toggled if the voltage is switched off and then back on within a predetermined number of seconds, for example, if the voltage is switched back on within 1 second of being switched off. However, the invention is not limited to any particular toggle delay, and the toggle delay may be user configurable.

Referring to FIG. 3, each successive toggling of the input voltage may cause the dimming controller 22 to dim the solid state light fixture at a different dimming level. For example, when the input voltage is first turned on, the dimming control circuit 22 may set the brightness level of the solid state lighting apparatus at a first brightness level, such as a highest brightness level (block 202). When the input voltage is toggled (TOGGLE 1), the dimming control circuit 22 may set the brightness level of the solid state lighting apparatus at a second brightness level, such as a medium brightness level (block 204).

When the input voltage is toggled again (TOGGLE 2), the dimming control circuit 22 may set the brightness level of the solid state lighting apparatus at a third brightness level, such as a low brightness level (block 206).

Finally, when the input voltage is toggled yet again (TOGGLE 3), the dimming control circuit 22 may set the brightness level of the solid state lighting apparatus back to the first brightness level (block 202).

Although FIG. 3 illustrates three brightness levels corresponding to three levels of dimming by the dimming control circuit 22, it will be appreciated that the dimming control circuit 22 may be configured to cycle through more than three or fewer than three brightness levels.

Figure 4:
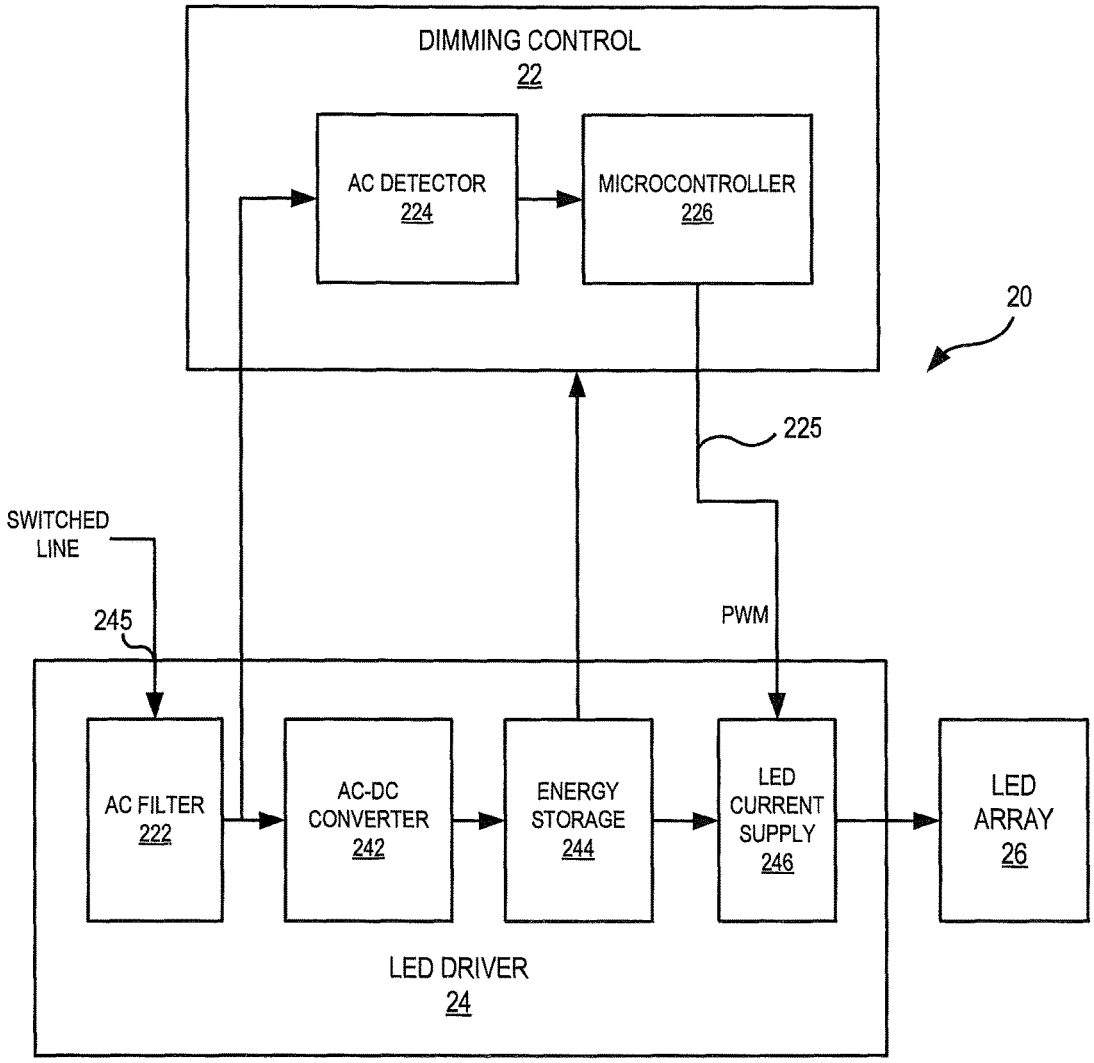
FIGS. 4, 5 and 6 are schematic diagrams of dimmable solid state lighting apparatus according to some embodiments.

FIG. 4 is a more detailed block diagram of a solid state lighting apparatus 20 according to some embodiments. As shown therein, the dimming control circuit 22 includes an AC detector 224 and a micro controller 226.

The LED driver includes an AC filter 222, an AC-DC converter 242, an energy storage device 244, which may include a capacitor, and an LED current supply circuit 246.

A switched line voltage is provided to the AC filter 222 through a power input 245 from, for example, the switch 10 of FIG. 1. The AC filter 222 provides a filtered AC voltage signal to the AC-DC converter 242, which responsively generates a DC operating voltage that is used by the LED current supply circuit 246 to generate a drive current for the LED array 26. The DC operating voltage is also supplied to an energy storage element 244, which may maintain the DC operating voltage at a suitable level when the input AC line voltage is toggled, and may also provide power to the dimming control circuit 22 to keep the microcontroller 226 active when the line voltage is switched off.

The filtered AC voltage signal is also provided to an AC detector 224 in the dimming control circuit 22. The AC detector 224 detects the presence or absence of the filtered AC voltage output by the AC filter 222 and responsively supplies an AC voltage detection signal to the microcontroller 226.

The microcontroller 226 monitors the AC voltage detection signal to determine if the AC line voltage is toggled off and then on in close succession. Responsive to detecting toggling of the AC line voltage, the microcontroller 226 generates a dimming signal 225, which may in some embodiments be a pulse width modulated dimming control signal. The dimming control signal 225 is supplied to the LED current supply circuit 246. The LED current supply circuit 246 sets a dimming level of the LED array 26 in response to the dimming control signal 225.

For example, in response to the dimming control signal 225, the LED current supply circuit 246 may adjust a level of current and/or voltage supplied to the LED array 26. In some embodiments, the LED current supply circuit 246 may adjust a duty cycle, or average current level, of one or more current signals supplied to the LED array 26, so that the light generated by the LED array 26 has a selected brightness level.

A solid state lighting apparatus according to some embodiments may be designed to respond to multiple types of dimming control signals including, for example, step dimming control signals, 0-10V dimming control signals, DALI dimming control signals, and other dimming control signals.

In some embodiments, a brightness of the LED array 26 may be set in response both to toggling of a power signal and an external dimming signal, such as a DALI dimming signal and/or a 0-10V dimming signal. For example, the external dimming signal may set a baseline maximum brightness level, and the microcontroller may cycle through different brightness levels in response to toggling of the power signal.

Figure 5:
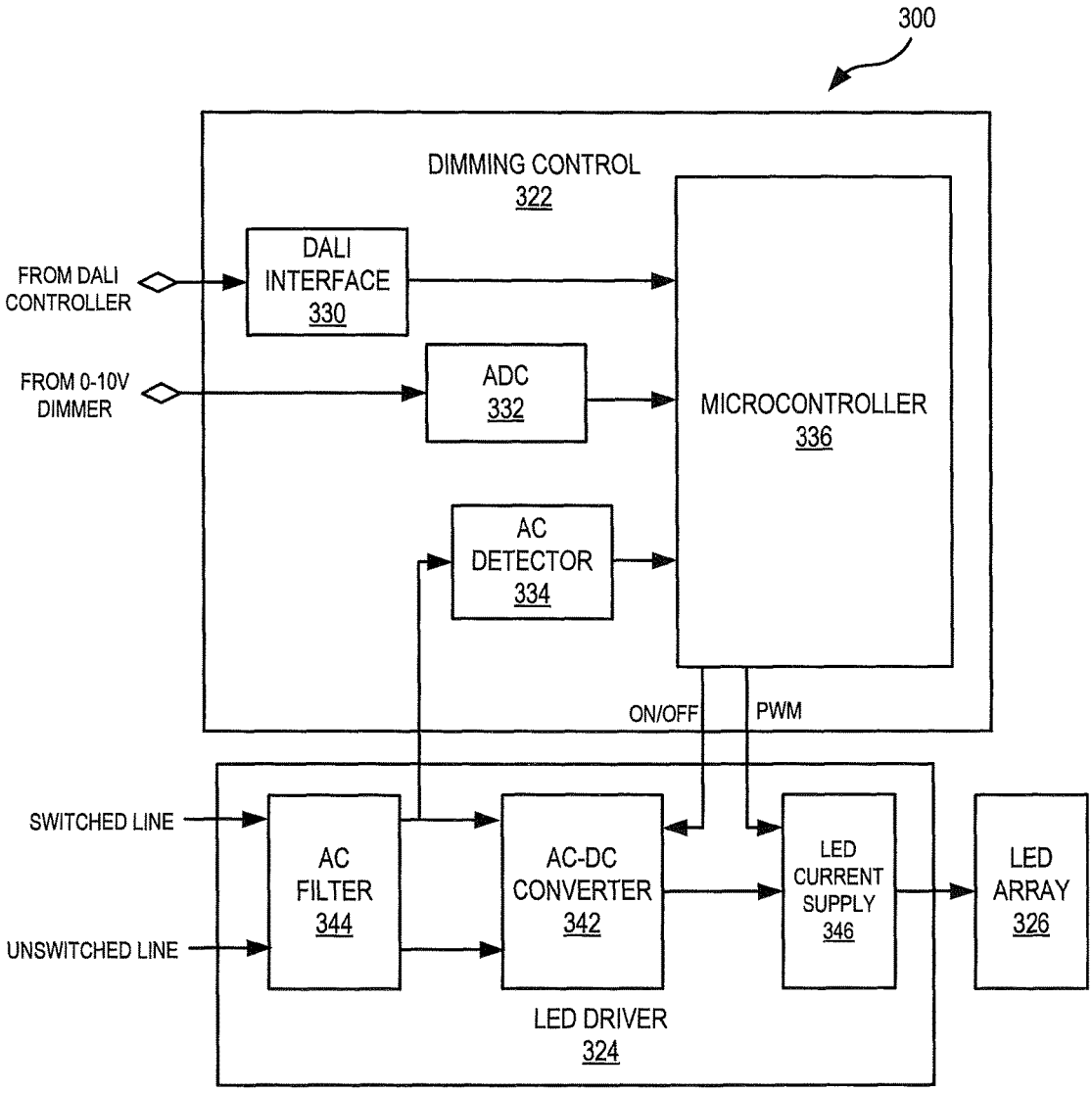

FIG. 5 is a block diagram of a solid state lighting apparatus 300 in accordance with further embodiments. The solid state lighting apparatus 300 may be configured to respond to a number of different types of dimming control inputs, such as a DALI dimming control signal and a 0-10V dimming control signal, in addition to dimming in response to toggling of an input voltage. The solid state lighting apparatus 300 includes a dimming control circuit 322, an LED driver 324 and an LED array 326.

The dimming control circuit 322 includes a microcontroller 336 and an AC detector 334. The LED driver circuit 324 includes an AC filter 344, an AC-DC converter 342 and an LED current supply circuit 346. The AC filter 344 may receive both a switched line voltage input and an unswitched line voltage input and supply both a switched and an unswitched filtered AC input to the AC-DC converter 342.

The dimming control circuit 322 may be configured/configurable to handle dimming signals generated by many different types of dimming systems, including step dimming, 0-10V dimming, and DALI dimming, in addition to toggled line voltage dimming as described above. For example, the dimming control circuit may include a 0-10V interface including an analog to digital converter 332 that is configured along with the microcontroller 336 to process a 0-10V dimming signal. Alternatively or additionally, the dimming control circuit 322 may also include a DALI dimming interface 330 that is configured to communicate with a DALI controller (not shown) and to receive and process DALI dimming signals.

The 0-10V interface is configured to detect the voltage level provided by a 0-10V dimmer and generate a PWM signal having a duty cycle related to the level of the 0-10V signal. For example, the duty cycle of the PWM signal generated by the 0-10V interface could be directly proportional to the voltage level of the 0-10V signal (e.g., generates a 50% duty cycle in response to a 5V signal, a 60% duty cycle in response to a 6V signal, etc.). In other embodiments, the duty cycle of the PWM signal may be related in a linear or nonlinear fashion to the voltage level of the 0-10V signal in order to provide, for example, PWM signals that result in linear changes in voltage output, actual light output, power output, perceived light output, etc., of the lighting apparatus.

The DALI interface 330 may include circuitry for communicating with a DALI controller using asynchronous, half-duplex, serial protocol over a two-wire differential bus. The microcontroller 336 may process the DALI signals to generate a PWM signal in response to dimming commands received over the DALI interface.

A jumper setting in the solid state lighting apparatus 300 may be used to indicate to the microcontroller 336 which type of dimming control is being used. In some embodiments, configuration data that is written to a programmable device at the time of manufacture may be used to identify the type of dimming control that is used.

Figure 6:
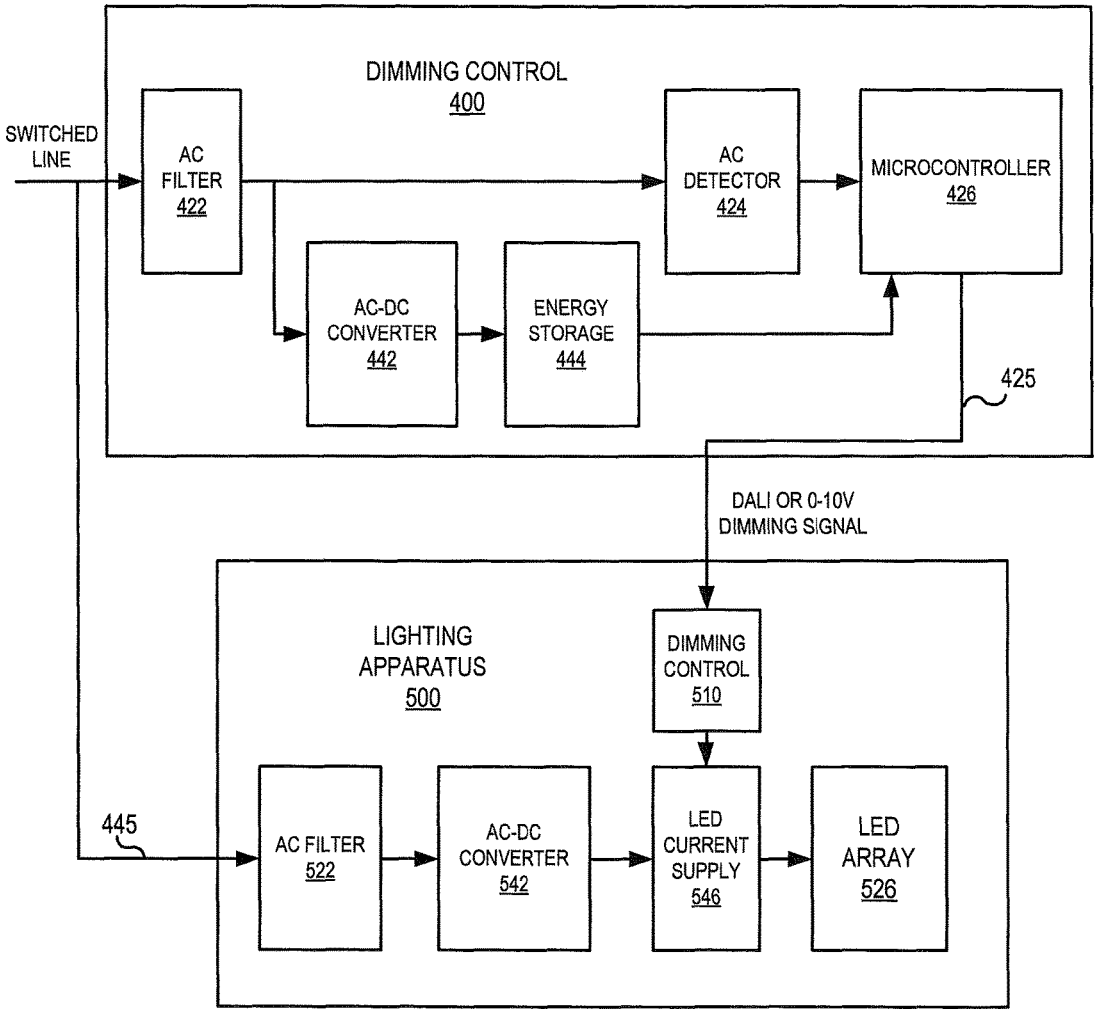

FIG. 6 is a more detailed block diagram of a dimming control circuit 400 for a solid state lighting apparatus 500. As shown therein, the dimming control circuit 400 includes an AC filter 422, an AC detector 424 and a microcontroller 426. The microcontroller receives an AC detection signal from the AC detector 424 and detects toggling of the input power signal 445. The dimming control circuit 400 may optionally include an AC-DC converter 442 and an energy storage element 444 that provide power to the microcontroller 426 even when the input power line 445 is toggled.

The solid state lighting apparatus 500 may include an AC filter 522, an AC-DC converter 542, an LED current supply circuit 546 and an LED array 526. The solid state lighting apparatus 500 further includes a dimming control circuit 510 that is configured to receive a conventional dimming signal, such as a DALI dimming signal and/or a 0-10V dimming signal and adjust the current output by the LED current supply circuit 546 accordingly.

The micro controller 426 monitors the AC voltage detection signal to determine if the AC line voltage is toggled off and then on in close succession. Responsive to detecting toggling of the AC line voltage, the microcontroller 426 generates a dimming signal 425, which may in some embodiments be a DALI or 0-10V dimming signal. The dimming control signal 425 is supplied to the dimming control circuit 510 in the solid state lighting apparatus 500, which may responsively output a PWM signal to the LED current supply circuit 546. The LED current supply circuit 546 thus sets a dimming level of the LED array 526 in response to the dimming control signal 425.

A dimming control circuit 400 may therefore be used to control a brightness level of a fixture that accepts a conventional dimming signal in response to toggling of an input power signal. It will be appreciated that the dimming control circuit 400 may be used to control dimming of any fixture that accepts a conventional dimming signal, and that the fixture need not be a solid state lighting fixture, but could include other types of lighting fixtures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical embodiments of the invention and, although specific terms are employed, they are used in a generic and descriptive sense only and not for purposes of limitation, the scope of the invention being set forth in the following claims.

What is claimed is:

1. A lighting apparatus, comprising:

a light source;

an AC power input; and an AC-DC converter having an input connected to the AC power input and an output configured to provide a DC voltage;

an AC detector having an input directly connected to an input of the AC-DC converter and an output configured to provide an indication whether AC power at the AC power input is switched on or off;

a dimming control module connected to the output of the AC detector and configured to generate a dimming control signal operative to change a brightness level of the light source from a first brightness level to a second brightness level in response to toggling of the AC power input within a predetermined time after the power signal is switched on;

a current supply module coupled to the dimming control module and the light source and configured to supply a level of current to the light source in response the dimming control signal output by the dimming control module; and an energy storage element coupled to the current supply module and configured to maintain a supply of power to the current supply module while the power signal is toggled.

2. The lighting apparatus of claim 1, wherein the dimming control module is configured to detect repeated toggling of the power signal and to set the brightness level of the light source to respective different levels in response to repeated toggling of the power signal by switching the power signal off, delaying for less than a toggle delay time, and switching the power signal back on again.

3. The lighting apparatus of claim 2, wherein the dimming control module is configured to cycle the brightness level of the light source from the first brightness level to the second brightness level that is lower than the first brightness level in response to toggling of the power signal.

4. The lighting apparatus of claim 2, wherein the dimming control module is configured to cycle the brightness level of the light source from a lowest brightness level to a highest brightness level in response to toggling of the power signal by switching the power signal off, delaying for less than the toggle delay time, and switching the power signal back on again.

5. The lighting apparatus of claim 1, wherein the dimming control module further comprises a dimming signal detector, wherein the dimming control module is configured to control the brightness level of the light source in response to toggling of the power signal and in response to a dimming control signal detected by the dimming signal detector.

6. The lighting apparatus of claim 5, wherein the dimming signal comprises a Digital Addressable Lighting Interface (DALI) dimming signal and/or a 0-10V dimming signal.

7. The lighting apparatus of claim 1, wherein the light source comprises a solid state lighting array.

8. The lighting apparatus of claim 1, wherein the dimming control module comprises a microcontroller.

9. The lighting apparatus of claim 1, wherein the dimming control module is configured to maintain a current dimming level if no toggling of the power signal is detected after the predetermined time has elapsed after the power signal is switched on.

10. The lighting apparatus of claim 1 wherein the level of current supplied to the light source by the current supply module is a DC current level.

11. The lighting apparatus of claim 1 wherein the level of current supplied to the light source by the current supply module is an average current level.

12. A method of operating a lighting device including a light source, comprising:

receiving a power signal at the lighting device;

changing a brightness level of the light source from a first brightness level to a second brightness level in response to toggling of the power signal;

controlling the brightness level of the light source in response to toggling of the power signal and in response to an external dimming control signal provided to the lighting device, wherein the external dimming control signal sets a baseline maximum brightness level and the brightness level of the light source is cycled through different brightness levels up to the baseline maximum brightness level set by the external dimming control signal in response to toggling of the power signal; and maintaining a supply of power to the light source while the power signal is toggled.

13. The method of claim 12, further comprising:

detecting toggling of the power signal within a predetermined time after the power signal is switched on; and changing the brightness level of the light source in response to toggling of the power signal within the predetermined time after the power signal is switched on.

14. The method of claim 12, further comprising:

detecting repeated toggling of the power signal; and setting the brightness level of the light source to respective different levels in response to repeated toggling of the power signal by switching the power signal off, delaying for less than a toggle delay time, and switching the power signal back on again.

15. The method of claim 14, further comprising:

cycling the brightness level of the light source from a high brightness level to a low brightness level in response to toggling of the power signal.

16. The method of claim 14, further comprising cycling the brightness level of the light source from a lowest brightness level to a highest brightness level in response to toggling of the power signal by switching the power signal off, delaying for less than the toggle delay time, and switching the power signal back on again.

17. The method of claim 12, wherein the external dimming control signal comprises a Digital Addressable Lighting Interface (DALI) dimming signal and/or a 0-10V dimming signal.

18. The method of claim 13 further comprising maintaining a current dimming level if no toggling of the power signal is detected after the predetermined time has elapsed after the power signal is switched on.

19. A solid state lighting apparatus, comprising:

an array of solid state lighting sources;

a power input configured to receive an AC power signal;

an AC-DC converter coupled to the power input and configured to convert the AC power signal to a DC power signal;

a current supply circuit coupled to the AC-DC converter and to the array of solid state lighting sources and configured to supply a drive current to the array of solid state lighting sources;

an AC detector coupled between the power input and the AC-DC converter, wherein the AC detector is configured to detect toggling of the AC power signal supplied at the power input within a predetermined time after the AC power signal is switched on; and a dimming control circuit coupled to the AC detector and to the current supply circuit and configured to generate a brightness control signal in response to the toggling of the AC power signal supplied at the power input within a predetermined time after the AC power signal is switched on;

wherein the current supply circuit is configured to receive the brightness control signal from the dimming control circuit and to set a level of the drive current supplied to the array of solid state lighting sources in response to the brightness control signal.

20. The solid state lighting apparatus of claim 19, wherein the brightness control signal generated from the dimming control circuit to the current supply circuit comprises a pulse width modulation signal.

21. The solid state lighting apparatus of claim 19, wherein the brightness control signal generated from the dimming control circuit to the current supply circuit comprises a Digital Addressable Lighting Interface (DALI) dimming signal and/or a 0-10V dimming signal.

* * * * *